US012679511B2

(12) United States Patent
Schultz et al.

(10) Patent No.: US 12,679,511 B2
(45) Date of Patent: Jul. 14, 2026

(54) WATER SPORTS EQUIPMENT STORAGE RACK

(71) Applicant: GereMarie Corporation, Lake Zurich, IL (US)

(72) Inventors: James A. Schultz, Lake Zurich, IL (US); Gregory G. Mackall, Lake Zurich, IL (US)

(73) Assignee: Geremarie Corporation, Lake Zurich, IL (US)

( * ) Notice: Subject to any disclaimer, the term of this patent is extended or adjusted under 35 U.S.C. 154(b) by 0 days.

(21) Appl. No.: 18/770,790

(22) Filed: Jul. 12, 2024

(65) Prior Publication Data

US 2024/0359776 A1 Oct. 31, 2024

Related U.S. Application Data

(63) Continuation of application No. 17/747,401, filed on May 18, 2022, now Pat. No. 12,037,086.

(60) Provisional application No. 63/190,007, filed on May 18, 2021.

(51) Int. Cl.
*B63B 32/83* (2020.01)
*A47B 81/00* (2006.01)

(52) U.S. Cl.
CPC ..... *B63B 32/83* (2020.02); *A47B 81/005* (2013.01)

(58) Field of Classification Search
CPC ..... B63B 32/83; B63B 25/002; A47B 81/005
See application file for complete search history.

(56) References Cited

U.S. PATENT DOCUMENTS 3,336,040 A 8/1967 Hermanns
4,582,015 A 4/1986 Hunter
4,858,802 A 8/1989 Hamby et al.
(Continued)

FOREIGN PATENT DOCUMENTS

FR 2532611 A1 3/1984
FR 2521416 B1 5/1984
WO 1982001357 A1 4/1982

OTHER PUBLICATIONS

Shawn Madison, "INSIDE: MasterCraft Boats," WakeBoarder.com, available at http://www.wakeboarder.com/display.phtml?a=262 (accessed Mar. 18, 2021).

(Continued)

*Primary Examiner* — Stanton L Krycinski
(74) *Attorney, Agent, or Firm* — Price Heneveld LLP

(57) ABSTRACT

A water sports equipment storage rack includes a seat configured to receive a first portion of a water sport device, an engagement member configured to linearly move in outward and inward directions between extended and retracted positions and to rotatably move about a pivot axis between an open position where the engagement member is spaced from the water sport device and a closed position where the engagement member abuts the water sport device thereby securing the water sport device within the water sports equipment storage rack, and a drive mechanism configured to linearly move the engagement member in the outward direction during a first portion of the linear movement of the engagement member and configured to rotatably move the engagement member from the closed position to the open position during a second portion of the linear movement of the engagement member.

26 Claims, 3 Drawing Sheets

(56) References Cited

U.S. PATENT DOCUMENTS

| | | | | |
|---|---|---|---|---|
| 4,863,082 | A | 9/1989 | Evans et al. | |
| 4,907,774 | A | 3/1990 | Shaw et al. | |
| 5,316,192 | A | 5/1994 | Ng | |
| 5,582,044 | A | 12/1996 | Bolich | |
| 5,752,638 | A | 5/1998 | Meeks | |
| 5,826,908 | A | 10/1998 | McBride | |
| 5,906,304 | A | 5/1999 | Baldacchino | |
| 6,390,309 | B1 | 5/2002 | Tucker | |
| 6,711,845 | B2 * | 3/2004 | Dubois | A47B 81/005 248/161 |
| 6,866,001 | B1 | 3/2005 | Cuccia | |
| 6,886,795 | B2 | 5/2005 | Schultz | |
| 7,896,175 | B1 | 3/2011 | Corr et al. | |
| 8,814,117 | B2 | 8/2014 | Bohanan et al. | |
| 8,869,998 | B2 | 10/2014 | Ferré Rangel et al. | |
| 9,045,090 | B2 | 6/2015 | Wilhelm | |
| 9,055,826 | B2 | 6/2015 | Curts et al. | |
| 9,429,269 | B2 | 8/2016 | Wilhelm | |
| 9,487,153 | B2 | 11/2016 | Ferré Rangel et al. | |
| 9,527,562 | B1 | 12/2016 | Sterling | |
| D801,080 | S | 10/2017 | Wilson | |
| 9,984,667 | B2 | 5/2018 | Walker | |
| 10,040,516 | B2 | 8/2018 | Zimmerman | |
| 10,150,540 | B2 | 12/2018 | Lake et al. | |
| 10,870,468 | B1 | 12/2020 | Hellweg | |
| 10,875,610 | B1 | 12/2020 | Hellweg | |
| 10,982,731 | B2 * | 4/2021 | Hancock | F16M 13/022 |
| 2004/0159759 | A1 | 8/2004 | Schultz | |
| 2005/0155999 | A1 | 7/2005 | Gasper | |
| 2006/0037527 | A1 | 2/2006 | Aff | |
| 2007/0057000 | A1 | 3/2007 | Webster | |
| 2007/0062992 | A1 | 3/2007 | Hepworth et al. | |
| 2007/0209567 | A1 | 9/2007 | Fee et al. | |
| 2014/0263906 | A1 | 9/2014 | Jesewitz | |
| 2015/0158431 | A1 | 6/2015 | Parnell et al. | |
| 2015/0338020 | A1 | 11/2015 | Jesewitz | |
| 2018/0022284 | A1 * | 1/2018 | Bessette | B60R 9/08 224/315 |
| 2021/0071738 | A1 | 3/2021 | Hancock et al. | |

OTHER PUBLICATIONS

Mastercraft Boat Deck Wakeboard Rack 554962 | CSX 07 Gere Marie, https:/lwww.greatlakesskipper.com (accessed Mar. 18, 2021).

Roswell Triton Clamping Board Rack, Wakemakers.com, https://www.wakemakers.com/products/roswell-triton-board-rack (accessed Mar. 18, 2021).

Skylon SkyLock Locking Board Racks, Wakemakers.com, https://www.wakemakers.com/products/skylon-skylock-locking-malibu-axis-board-rack (accessed Mar. 18, 2021).

Wanted: single wakeboard rack for '03 X-10, MasterCraft Team Talk, https://teamtalk.mastercrafl.com/forum/general-mastercraft-topics/general-discussion/33332-wanted-single-wakeboard-rack-for-03-x-10?1=3404 7 (accessed Mar. 18, 2021).

Commonly assigned co-pending U.S. Appl. No. 17/747,401, filed May 18, 2022, including Information Disclosure Statement filed May 18, 2022.

* cited by examiner

WATER SPORTS EQUIPMENT STORAGE RACK

CROSS-REFERENCE TO RELATED APPLICATIONS

This application is a continuation of U.S. patent application Ser. No. 17/747,401, filed May 18, 2022, entitled "WATER SPORTS EQUIPMENT STORAGE RACK," which claims the benefit under 35 U.S.C. § 119(e) of U.S. Provisional Patent Application No. 63/190,007, filed May 18, 2021, entitled "WATER SPORTS EQUIPMENT STORAGE RACK," the entireties of which are incorporated herein by reference.

FIELD OF THE INVENTION

The invention relates to an apparatus for storing water sports equipment, particularly on a boat.

BACKGROUND OF THE INVENTION

Boats, particularly recreational boats, are designed for multiple activities on the water. Such activities include water sports such as wake surfing, wakeboarding, water skiing, and the like. These water sports require the use of various equipment such as surfboards, wakeboards, water skis, and the like.

SUMMARY OF THE INVENTION

In one aspect, the invention relates to a water sports equipment storage rack. The water sports equipment storage rack includes at least one U-shaped support including a slot, a claw, a drive mechanism, and a biasing member. The claw includes a tip. The claw is (i) configured to linearly move in an outward direction away from the slot and in an inward direction towards the slot and (ii) rotatable about a pivot axis between an open position and a closed position such that the tip of the claw is closer to the slot in the closed position than it is in the open position. The drive mechanism is configured to linearly move the claw in the outward direction and the inward direction. The biasing member is configured to (i) impart a biasing force to rotate the claw about the pivot axis in a direction toward the closed position and (ii) reduce the biasing force as the claw approaches the end of its linear travel, allowing the claw to move to the open position.

In another aspect, the invention relates to a water sports equipment storage rack. The water sports equipment storage rack includes a pair of U-shaped supports, a claw, a drive mechanism, and a biasing member. The pair of U-shaped supports is spaced apart from each other by a distance. Each U-shaped support includes a slot with an opening. The slot has a first end, a second end, and a centerline. The opening of the slot is on the second end of each slot. The slots of each U-shaped are aligned with each other in a direction transverse to the centerline of each slot. The claw is positioned between the U-shaped supports and includes a tip. The claw is (i) configured to linearly move in an outward direction away from the slots and in an inward direction towards the slots and (ii) rotatable about a pivot axis between an open position and a closed position such that the tip of the claw is closer to the slot in the closed position than it is in the open position. The drive mechanism is configured to linearly move the claw in the outward direction and the inward direction. The biasing member is configured to (i) impart a biasing force to rotate the claw about the pivot axis in a direction toward the closed position and (ii) reduce the biasing force as the claw approaches the end of its linear travel, allowing the claw to move to the open position.

In a further aspect, the invention relates to a water sports equipment storage rack assembly having a plurality of racks. Each rack of the plurality of racks includes a pair of U-shaped supports, a claw, a drive mechanism, and a biasing member. The pair of U-shaped supports is spaced apart from each other by a distance. Each U-shaped support includes a slot with an opening. The slot has a first end, a second end, and a centerline. The opening of the slot is on the second end of each slot. The slots of each U-shaped are aligned with each other in a direction traverse to the centerline of each slot. The claw is positioned between the U-shaped supports and includes a tip. The claw is (i) configured to linearly move in an outward direction away from the slots and in an inward direction towards the slots and (ii) rotatable about a pivot axis between an open position and a closed position such that the tip of the claw is closer to the slot in the closed position than it is in the open position. The drive mechanism is configured to linearly move the claw in the outward direction and the inward direction. The biasing member is configured to (i) impart a biasing force to rotate the claw about the pivot axis in a direction toward the closed position and (ii) reduce the biasing force as the claw approaches the end of its linear travel, allowing the claw to move to the open position.

These and other aspects of the invention will become apparent from the following disclosure.

BRIEF DESCRIPTION OF THE DRAWINGS

In FIG. 4, a claw of the claw mechanism is in a closed position.

DETAILED DESCRIPTION OF THE PREFERRED EMBODIMENTS

As used herein, directional terms forward (fore), aft, inboard, and outboard have their commonly understood meaning in the art. Relative to the boat, forward is a direction toward the bow, and aft is a direction toward the stem Likewise, inboard is a direction toward the center of the boat and outboard is a direction away from it.

As noted above, water sports require the use of various equipment such as surfboards, wakeboards, water skis, and the like. When not in use, this equipment preferably is stored on the boat, such as in racks or compartments. These racks and compartments may be designed to maximize the space onboard the boat and prevent the equipment from moving around while stored. Surfboards and wakeboards (boards) may be relatively large, having lengths greater than 4½ feet and widths of 20 inches or greater, and a rack may be a preferred method of storing the surfboards and wakeboards. The rack is preferably designed to allow a person (user) to easily place the board into the rack and remove it from the rack, and still securely hold the board in the rack while the boat is underway.

Figure 1:
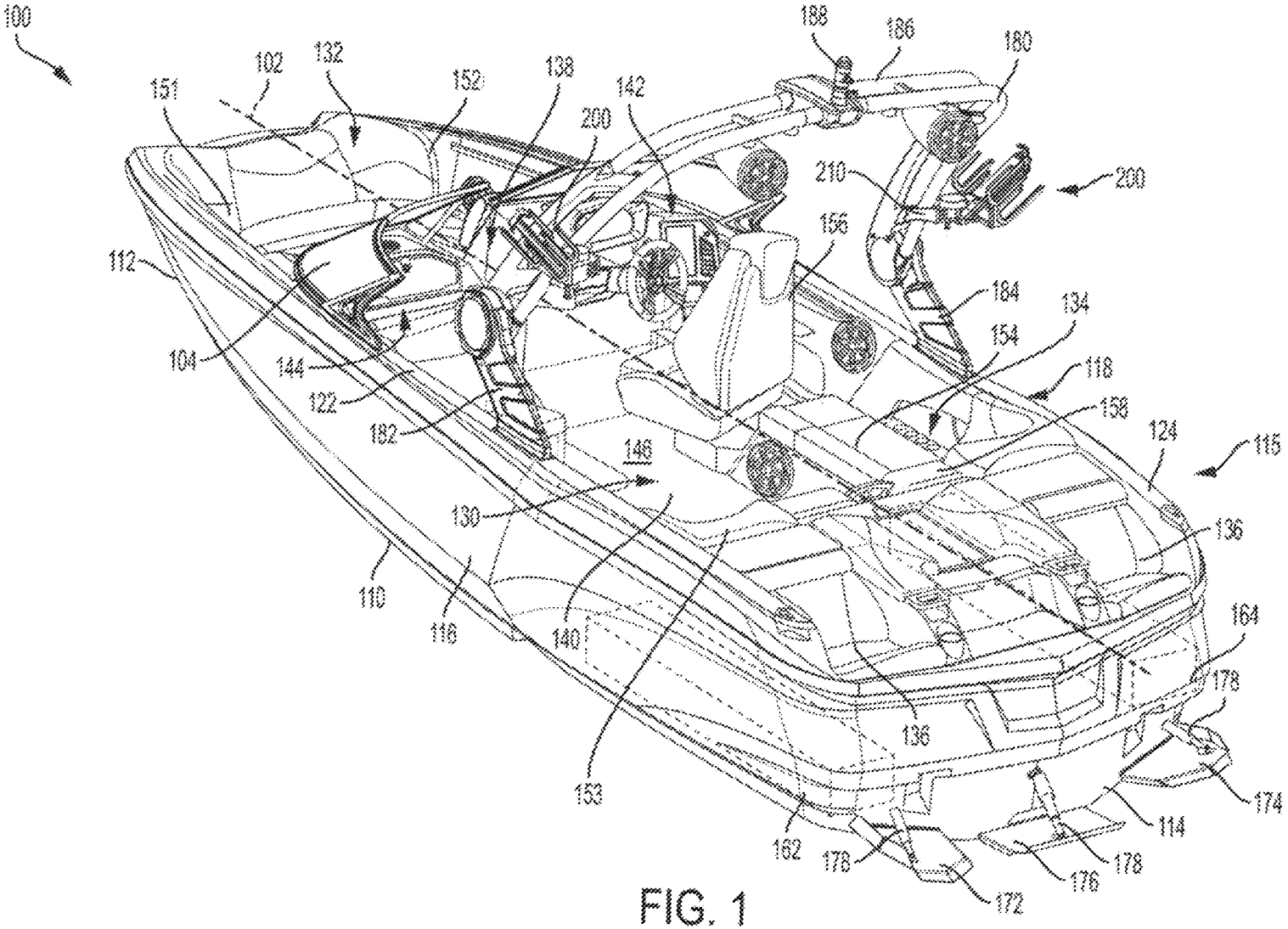
FIG. 1 is a perspective view of a boat including a rack assembly for holding water sports equipment according to a preferred embodiment of the invention.

FIG. 1 shows a boat 100 with a rack assembly 200 in accordance with an exemplary preferred embodiment of the invention. The boat 100 includes a hull 110 with a bow 112, a transom 114, a port side 116, and a starboard side 118. The boat also includes a stem 115. The port and starboard sides 116, 118 have port and starboard gunwales 122, 124, respectively. The boat 100 has a centerline 102 running down the middle of the boat 100, halfway between the port and starboard sides 116, 118. Collectively, the bow 112, the transom 114, and the port and starboard sides 116, 118 define an interior 130 of the boat 100.

In the embodiment shown in FIG. 1, the boat 100 is a bowrider having both a bow seating area 132 positioned in the bow 112 of the boat 100 and a primary seating area 134 (sometimes also referred to as the cockpit) positioned aft of a windshield 104. The boat 100 shown in FIG. 1 also has a pair of aft-facing seats 136, such as those described in U.S. Pat. No. 9,650,117, which is incorporated by reference herein in its entirety. Also within the boat's interior 130 is a control console 142 for operating the boat 100 and a passenger side console 144. Here, the control console 142 is positioned on the starboard side of the boat 100 proximate to and aft of the windshield 104, and the passenger side console 144 is positioned on the port side of the boat 100 proximate to and aft of the windshield 104. Together the control console 142 and the passenger side console 144 separate the bow seating area 132 from the primary seating area 134. A walkway 138 connects the bow seating area 132 with the primary seating area 134 and separates the control console 142 and the passenger side console 144. Although described in reference to a bowrider, this invention may be used with any suitable boat including cuddies, center consoles, pontoon boats, and cruisers, for example. The invention is also not limited to boats with single decks but may also be used with other boats that have multiple decks such as a flybridge.

The control console 142 encloses various controls for operating the boat 100. Suitable controls include those shown and described in U.S. Patent Application Publication No. 2018/0314487, which is incorporated by reference herein in its entirety, for operating the boat 100, the various devices described herein, and other systems, including, for example, audio systems. The boat 100 is driven by a single inboard motor (not shown) connected to a propeller (not shown) by a drive shaft (not shown). However, this invention can be utilized with other types of boats and propulsion systems, including but not limited to outboard motors, stem drives, jet drives, and the like.

The boat 100 has a deck 140 which includes a floor 146. Passenger seating, such as port and starboard bench seating 151, 152, 153, 154 in both the bow seating area 132 and primary seating area 134, may be constructed on elevated portions (seat support structures) of the deck 140. As used herein, these portions are elevated with respect to the level of the floor 146. Other seating locations within the boat's interior 130 include a captain's chair 156 at the control console 142 and a reversible bench seat 158. Although the invention is described with reference to a particular seating arrangement, different seating arrangements are contemplated to be within the scope of the invention.

The deck 140 may also include two support structures (elevated portions of the deck) for the control console 142 and the passenger side console 144. The windshield 104 is mounted, in part, on forward portions of the support structures for the control console 142 and the passenger side console 144. In this embodiment, the windshield 104 is mounted directly to a forward portion of the support structures and the gunwales 122, 124, but the windshield 104 may be suitably mounted to other portions of the control console 142 and the passenger side console 144. Near the walkway 138 or centerline 102 of the boat 100, the windshield 104 is oriented such that it is perpendicular to the centerline 102 of the boat 100. Moving outboard from the centerline 102 of the boat 100, the windshield 104 is curved such that it smoothly transitions to an orientation that is parallel to or co-planar with the port side 116 or starboard side 118 of the hull 110 near the gunwales 122, 124, which in this embodiment is generally parallel to the centerline 102 of the boat 100.

The boat 100 may also include a horizontal swim platform (not shown) attached to the transom 114 to make it easier for people to get into the water from the boat 100 or into the boat 100 from the water. The swim platform is omitted from FIG. 1 for clarity, but a suitable swim platform is shown and described in U.S. Patent Application Publication No. 2018/0314487, which is incorporated by reference herein in its entirety. Such swim platform should be capable of supporting a human and is preferably capable of supporting at least 500 lbs., and even more preferably 1250 lbs. The swim platform may be constructed from any suitable material that may be used in a marine environment including, for example, fiberglass or teak. In this embodiment, the swim platform may be attached to the transom 114 of the boat 100 using, for example, two brackets screwed to the transom 114; however, the swim platform may be attached to the transom 114 by any suitable means. While the swim platform is described as an attachable/detachable platform, it is not so limited. For example, the swim platform may be integrally formed with the stem of the boat 100.

The boat 100 may include the capability to add ballast. Ballast may be used to increase the weight and displacement of the boat 100 and increase the size of the wake for water sports such as wakeboarding or wake surfing. Any suitable means to add ballast may be used including ballast bags (sacks) or ballast tanks. The boat 100 shown in FIG. 1 includes three ballast tanks. Preferably, two ballast tanks are positioned in the stem of the boat near the bottom of the hull, one on each side of the boat (a port ballast tank 162 and a starboard ballast tank 164). A third ballast tank (not shown) is positioned along the centerline 102 of the boat 100 near the bottom of the hull 110, forward of the two stem ballast tanks 162, 164. Ballast bags may be used in addition to the ballast tanks 162, 164 and may be plumbed into the ballast system of the boat 100. Preferably, the ballast bags are positioned above the stem ballast tanks 162, 164 in a compartment underneath the aft-facing seats 136. Both the ballast tanks 162, 164 and the ballast bags operate similarly in that water may be pumped into the tank or bag by ballast pumps to add weight.

The boat 100 may be equipped with surf devices 172, 174, which may be used to shape the wake of the boat for wake surfing. Any suitable surf devices may be used including, for example, the port and starboard wake-modifying devices disclosed in U.S. Pat. No. 8,833,286, which is incorporated by reference herein in its entirety. Each of the port and starboard surf devices 172, 174 includes a plate-like member that is pivotably attached to the transom 114 of the boat 100. The plate-like members pivot about pivot axes to move between a non-deployed position and a deployed position. In this embodiment, the pivot axes are hinges. Here, the hinges are piano hinges that are welded to a leading portion of each plate-like member and attached to the transom 114 of the boat 100 using screws. However, any suitable pivotable connection may be used and may be affixed to the transom 114 of the boat 100 and the port and starboard surf devices 172, 174 using any suitable means, including but not limited to bolts, screws, rivets, welding, and epoxy. Each of the port and starboard surf devices 172, 174 also may include one or more downturned and/or upturned surfaces, such as downturned surfaces at the trailing edge of the plate-like members that are angled at a downward angle relative to the plate-like member. However, as noted above, any suitable surf device may be used and other suitable surf devices may include, for example, the port and starboard wake-modifying devices disclosed in U.S. Pat. No. 9,802,684, which is incorporated by reference herein in its entirety.

As shown in FIG. 1, the boat 100 also is equipped with a central trim device (center tab 176) positioned to span the centerline 102 of the boat. Any suitable trim device may be used, but in this embodiment, the center tab 176 is a generally rectangular trim tab that is pivotably attached to the transom 114 of the boat 100. The center tab 176 includes a plate-like member and pivots about a pivot axis to move between a non-deployed position and a deployed position. Like the pivot axes of the surf devices 172, 174, the pivot axis of the center tab 176 may be any suitable pivotable connection affixed to the transom 114 of the boat 100.

Each of the surf devices 172, 174 and the center tab 176 is moveable between the deployed position and the non-deployed position by a drive mechanism 178. In the embodiment shown, one drive mechanism 178 is used for each surf device 172, 174 and the center tab 176, allowing them to be independently operated. Each of the drive mechanisms 178 shown in this embodiment is a linear actuator. The linear actuator preferably is an electric linear actuator, such as one available from Lenco Marine. One end of the linear actuator is connected to the transom 114 of the boat 100 and the other end is connected to the surf device 172, 174 or center tab 176. Any suitable means may be used to move the surf devices 172, 174 and the center tab 176 between the deployed and non-deployed positions, including but not limited to hydraulic linear actuators, gas assist pneumatic actuators, and electrical motors.

The boat 100 is also equipped with an apparatus for towing a water sports participant. As shown in FIG. 1, the towing apparatus is a tower 180 that is particularly used for towing a wakeboarder. Any suitable tower 180 may be used including, for example, those described in U.S. Pat. Nos. 9,580,155 and 10,150,540, which are incorporated by reference herein in their entireties. The tower 180 includes two legs: a port leg 182 and a starboard leg 184. The port leg 182 is attached on the port side of the centerline 102 of the boat 100, and the starboard leg 184 is attached on the starboard side of the centerline 102 of the boat 100. Preferably, the port and starboard legs 182, 184 are attached to the port gunwale 122 and to the starboard gunwale 124, respectively. The tower 180 also includes a header 186. The header 186 is connected to an upper portion of each of the two legs 182, 184 and spans the interior 130 of the boat 100 at a height suitable for passengers to pass underneath while standing. In addition, the tower 180 has a tow-line-attachment structure 188 at an upper portion of the tower 180 (the header 186 in this embodiment). This tow-line-attachment structure 188 may be used to connect a tow-line suitable for towing a water sports participant, such as a wakeboarder. Any suitable tow-line-attachment structure may be used, including but not limited to the integrated light and tow-line-attachment assembly disclosed in U.S. Pat. No. 6,539,886, which is incorporated by reference herein in its entirety.

The rack assembly 200 is configured to attach to the tower 180 and, more specifically in this embodiment, to the port leg 182 and the starboard leg 184 of the tower 180. The rack assembly 200 includes a mounting structure 210 that is attached to one of the port leg 182 and the starboard leg 184. In FIG. 1, the rack assembly 200 is shown attached to the port leg 182 and the starboard leg 184 by the mounting structure 210. The orientation of the rack assembly 200 attached to the port leg 182 obscures the view of the mounting structure 210, but the mounting structure 210 attached to the port leg 182 is a mirror image of the attached to the starboard leg. The mounting structure 210 may include a stay 212 (see FIGS. 2 and 3), one end of the stay 212 may be attached to the port leg 182 and starboard leg 184. The stay 212 may be attached to the port leg 182 and starboard leg 184 using any suitable means including, for example, welding or bolts. Although shown with one rack assembly 200 mounted to each of the port leg 182 and the starboard leg 184, multiple rack assemblies 200 may be attached to each of the port leg 182 and the starboard leg 184 or other portions of the tower 180. In addition, the rack assembly 200 may be attached to other portions of the boat 100.

Figure 2:
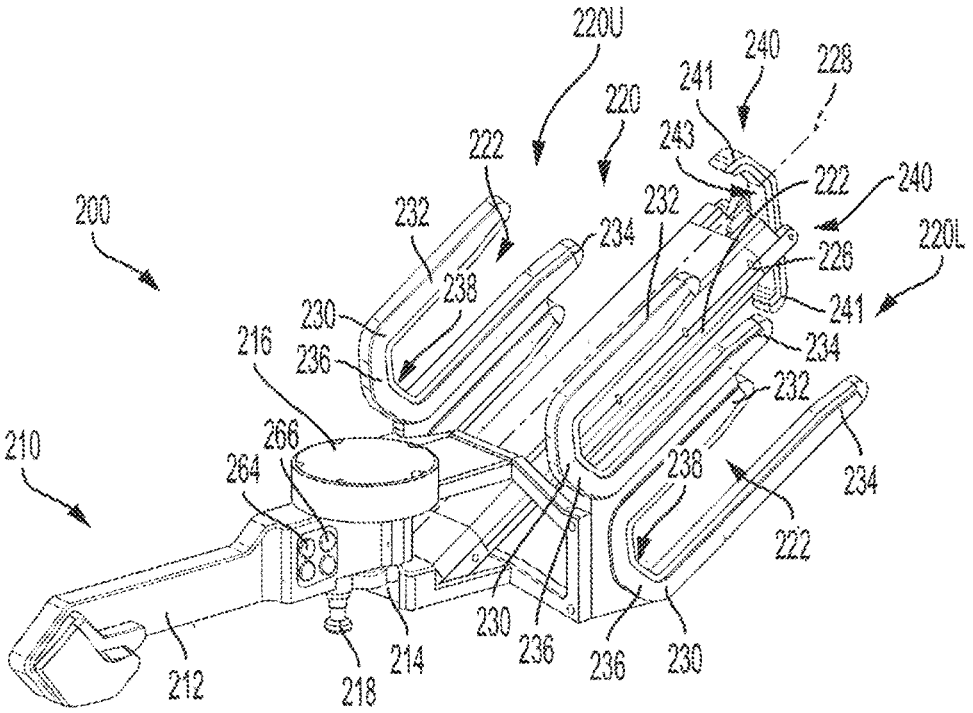
FIG. 2 is a perspective view of the rack assembly shown in FIG. 1.
Figure 3:
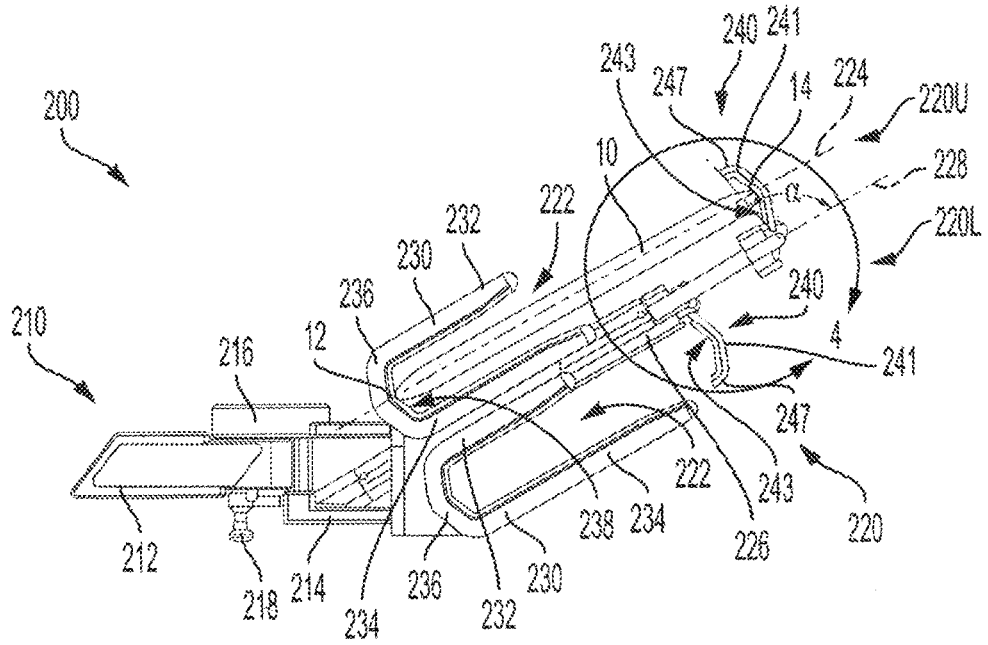
FIG. 3 is a side elevation view of the rack assembly shown in FIG. 1.

FIG. 2 is a perspective view of the rack assembly 200, and FIG. 3 is a side view of the rack assembly 200. The rack assembly 200 includes at least one rack 220. In this embodiment, the rack assembly 200 includes a plurality of racks 220, an upper rack 220U and a lower rack 220L; although, any suitable number of racks 220 may be used. The term rack 220, which may refer to an individual rack, such as one of the upper rack 220U and the lower rack 220L, is also used herein to refer collectively to the plurality of racks 220, such as collectively to both the upper rack 220U and the lower rack 220L.

As noted above, the rack assembly 200 includes the mounting structure 210. One end of the stay 212 of the mounting structure 210 is attached to the tower 180, and the rack 220 is connected to the other end of the stay 212. In this embodiment, the rack 220 is pivotably connected to the stay 212. The rack 220 attaches to a support bracket assembly 214, and the support bracket assembly 214 is pivotably connected to the stay 212 by a hub 216. The hub 216 allows the rack 220 to rotate. In this embodiment, the hub 216 has a pivot axis that is generally vertical and the hub 216 enables the rack 220 to rotate 180 degrees such that the rack 220 can be positioned outboard of the corresponding gunwale and/or side of the hull or rotated 180 degrees to be positioned inboard of the gunwale and over the deck 140. As shown in FIG. 1, for example, the rack 220 attached to the port leg 182 is outboard of the port gunwale 122 and the port side 116 of the hull 110 such that the rack 220 is over the water, and the rack 220 attached to the starboard leg 184 is outboard of the starboard gunwale 124 and the starboard side 118 of the hull 110 such that the rack 220 is over the water. FIGS. 2 and 3 show the rack 220 in an orientation that corresponds to an aft-facing position of the rack 220, when the rack assembly 200 is mounted to the tower 180 in the manner shown in FIG. 1. The mounting structure 210 of this embodiment includes a knob 218 that can be moved (pulled downward in this embodiment) by a person (user) to release a locking mechanism and allow the rack 220 to rotate about the pivot axis of the hub 216.

The features and operation of the upper rack 220U and the lower rack 220L are the same, and the following description of the upper rack 220U also applies to the lower rack 220L.

The upper rack 220U includes a plurality of U-shaped supports 230. In this embodiment, the upper rack 220U includes a pair of U-shaped supports 230. Each U-shaped support 230 defines a slot 222. More specifically in this embodiment, the U-shaped support 230 includes two prongs, an upper prong 232 and a lower prong 234. The slot 222 is formed between the upper prong 232 and the lower prong 234, and, in this embodiment, the slot 222 is elongated having a lower end (first end) and an upper end (second end). In this embodiment, the upper prong 232 and the lower prong 234 are oriented parallel to each other, but the upper prong 232 and the lower prong 234 may have other orientations with the slot 222 formed therebetween. For example, one of the upper prong 232 and the lower prong 234 being oriented with a small acuate angle relative to the other prong 232, 234 so that the open end (second end or upper end) of the slot 222 is wider than the lower end (first end). A centerline 224 of the slot 222 is located halfway between the upper prong 232 and the lower prong 234 and extends from the lower end to the upper end. The U-shaped support 230 also includes a cross support 236 connecting the upper prong 232 to the lower prong 234 to form the U-shape. The cross support 236 is located at the lower end of the slot 222 and includes a contact surface 238 that faces the slot 222. The upper end of the slot 222 is open (having an opening).

The slot 222 is configured to receive a board 10 (e.g., wakeboard or surfboard), as shown, for example, in FIG. 3. In this embodiment, the slot 222 is oriented at an upward angle such that gravity will help secure the board 10 in the upper rack 220U. In this embodiment, the orientation of the slot 222 may be taken with respect to the centerline 224 of the slot 222. Preferably, the upward angle of the slot 222 is an angle greater than 0 degrees and less than or equal to 90 degrees relative to the floor 146, although the slot 222 can have other angles, such as generally horizontal (parallel to the floor 146), for example. When positioned in the slot 222, a first side edge 12 of the board 10 contacts and rests on the contact surface 238 of the cross support 236. To help position the board 10 in the slot 222, the contact surface 238 is curved or has a V-shape, and the board 10, specifically the first side edge 12, can be positioned against the vertex of the contact surface 238.

The board 10 is positioned in the slot 222 with the width of the board 10 aligned in the direction of the slot 222. When the board 10 is secured in the slot 222, as will be discussed further below, a centerline of the board 10 may be coincident with the centerline 224 of the slot 222. The U-shaped supports 230 are spaced apart from each other by a distance. The U-shaped supports 230 also are positioned with the slots 222 of each U-shaped support 230 aligned with each other in the lengthwise direction of the board 10, such that the first side edge 12 of the board 10 contacts each contact surface 238 of the pair of U-shaped supports 230. The upper rack 220U is configured to contact the board 10 at at least two positions on the first side edge 12 of the board 10. The lengthwise direction of the board 10 is a direction transverse to the centerline 224 of the slot 222, and more specifically, a direction orthogonal to the centerline 224 of the slot 222.

The rack assembly 200 includes a claw mechanism 240 having a claw 241. To secure the board 10 is secured in place, the claw 241 presses the board 10 against both contact surfaces 238 of the U-shaped supports 230. The claw 241 has a contact surface 243 configured to contact a second side edge 14 of the board 10. As with the contact surface 238 of the cross support 236, the contact surface 243 of the claw 241 is curved or has a V-shape, and the board 10, specifically the second side edge 14, can be positioned against the vertex of the contact surface 243 to help position the board 10 in the slot 222. With the first side edge 12 and the second side edge 14 of the board 10 in the vertex of the contact surface 238 of the cross support 236 and the vertex of the contact surface 243 of the claw 241, the board 10 is raised such that it does not rest on or contact the upper prong 232 and the lower prong 234, as shown in FIG. 3, for example, and the centerline of the board 10 may be coincident with the centerline 224 of the slot 222.

In this embodiment, as shown in FIG. 2, one claw 241 and claw mechanism 240 is used for each of the upper rack 220U and lower rack 220L, but alternatively a plurality of claws 241 and claw mechanisms 240 may be used for each of the upper rack 220U and lower rack 220L. When one claw 241 is used, the claw 241 preferably is positioned between the pair of U-shaped supports 230, and more specifically, about halfway between the pair of U-shaped supports 230. The claw 241 preferably may be positioned in the middle third of the distance between the pair of U-shaped supports 230 and more preferably in the middle quarter of the distance between the pair of U-shaped supports 230. The middle quarter is an eighth of the distance between the pair of U-shaped supports 230 on either side of the distance halfway between the pair of U-shaped supports 230. The claw 241, however, is not so limited and may be positioned in line with one of the U-shaped supports 230 or outside of the U-shaped supports 230. Such positions may be preferable when a plurality of claws 241 are used.

Figure 4:
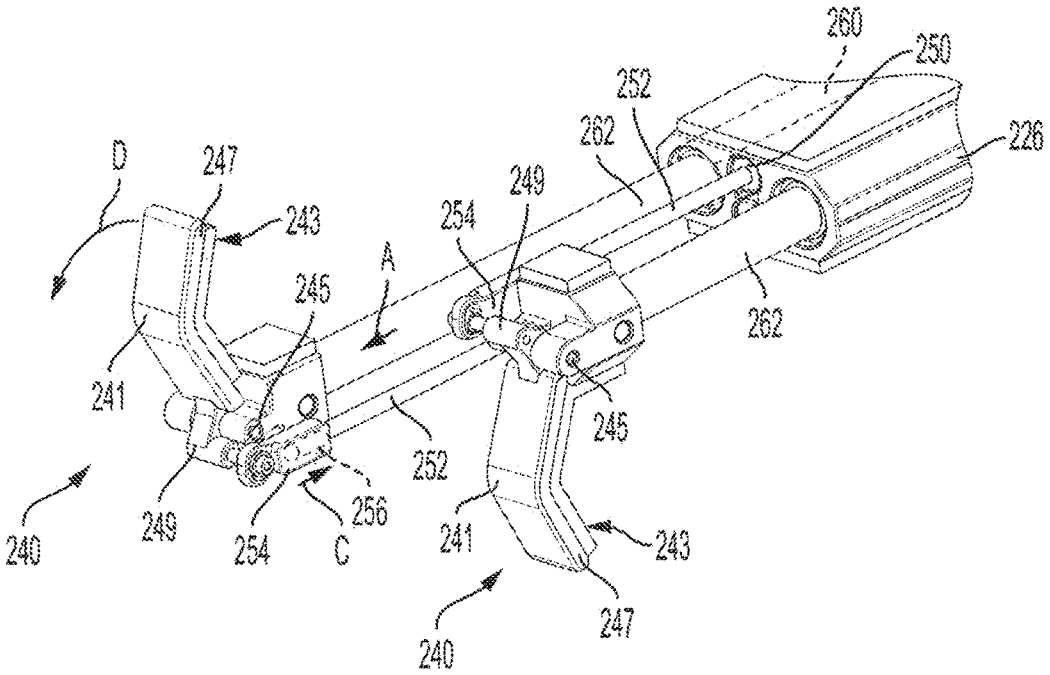
FIG. 4 is a detailed perspective view of a claw mechanism of the rack assembly, showing detail 4 of FIG. 3.
Figure 5:
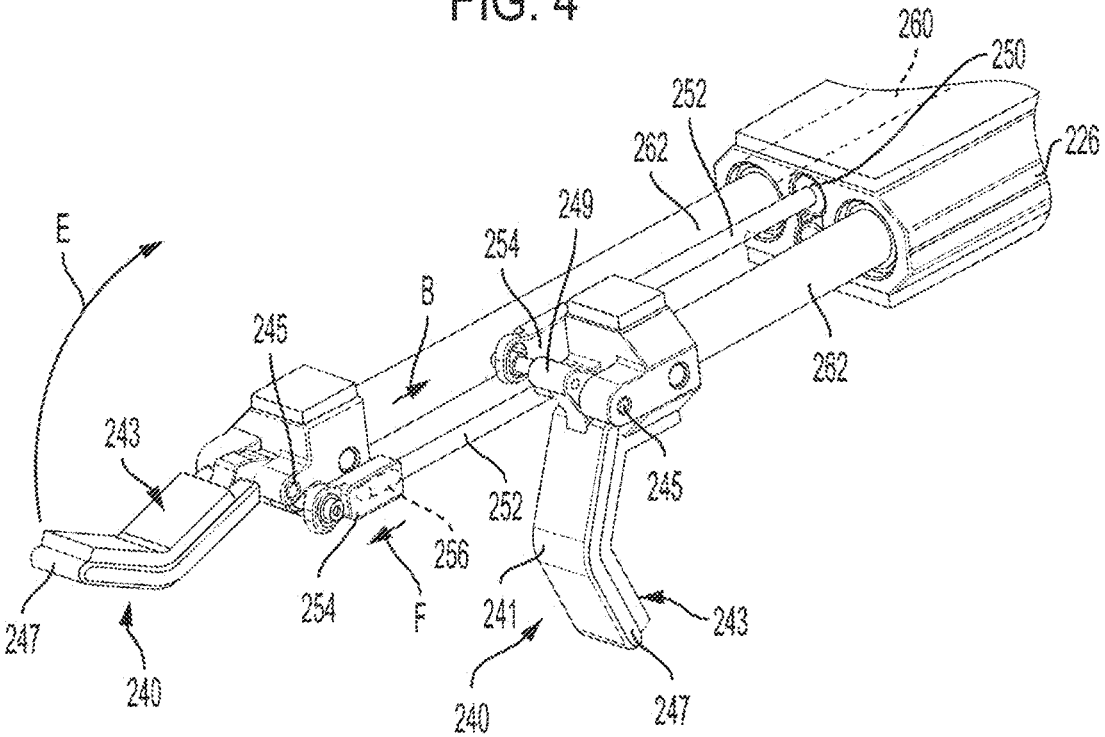
FIG. 5 is the detail perspective view shown in FIG. 4 with the claw of the claw mechanism in an open position.

The claw 241 is moveable to secure and release the board 10 in the upper rack 220U. The operation of the claw 241 and the claw mechanism 240 to secure and release the board 10 will be described with reference to FIGS. 4 and 5. FIGS. 4 and 5 are detail views of detail 4 of FIG. 3. FIG. 4 shows the claw 241 of the claw mechanism 240 in a closed position, and FIG. 5 shows the claw 241 of the claw mechanism 240 in an open position. The board 10 is omitted in FIGS. 4 and 5 for clarity. The claw 241 moves linearly, specifically rectilinearly in a direction parallel to the centerline 224 of the slot 222 in this embodiment (directions A and B, discussed below). The claw 241 may be moved by a powered drive mechanism, such as a powered actuator 260 in this embodiment. The powered actuator 260 shown in this embodiment is a linear actuator, and preferably is an electric linear actuator powered by the electrical system of the boat 100. However, any suitable means may be used to move the claw 241, including but not limited to other powered actuators (e.g., hydraulic linear actuators, pneumatic actuators) and electrical motors.

In the preferred embodiment shown, the rack assembly 200 includes two powered actuators 260, one for each of the upper rack 220U and the lower rack 220L. Both powered actuators 260 are located in an actuator housing 226 (see also FIG. 2). In this embodiment, the powered actuators 260 are arranged in a side-by-side arrangement with the powered actuator 260, and thus the claw 241, for the upper rack 220U being closer to one of the U-shaped supports 230 (a first U-shaped support) and the powered actuator 260, and thus the claw 241, for the lower rack 220L being closer to the other one of the U-shaped support 230 (a second U-shaped support). The powered actuators 260 are enclosed within the actuator housing 226. The actuator housing 226 is symmetrical with a centerline 228 of the actuator housing 226 being halfway between the pair of U-shaped supports 230 and one powered actuator 260 being on either side of the centerline 228 of the actuator housing 226 (see FIG. 2). The centerline 228 of the actuator housing 226 is oriented parallel to the centerline 224 of the slot 222 in this embodiment. The actuator housing 226 is positioned between the slot 222 of the upper rack 220U and the slot 222 of the lower rack 220L such that the actuator housing 226 does not interfere with placing the board 10 into the upper rack 220U or lower rack 220L (see FIG. 3).

The powered actuator 260 includes a rod 262 that moves outward from the actuator housing 226 in direction A (FIG. 4) and inward toward the actuator housing 226 in direction B (FIG. 5). Directions A and Bare directions parallel to the centerline 224 of the slot 222 and the centerline 228 of the actuator housing 226. Direction A may be a direction outward from the slot 222 or an outward direction, and direction B is a direction inward toward the slot 222 or an inward direction. The claw 241 is pivotably attached to the end of the rod 262 and moves with the rod 262. The claw 241 is configured to move in the inward direction (direction B) and the outward direction (direction A) as the rod 262 travels in the inward direction (direction B) and the outward direction (direction A). The claw 241 pivots about a pivot axis 245 that crosses the direction of travel of the rod 262 (directions A and B). More specifically in this embodiment, the pivot axis 245 is perpendicular to the direction of travel of the rod 262 (directions A and B). A user controls the powered actuator 260 using an input device, such as a switch. In this embodiment, each actuator includes two buttons, an IN button 264 and an OUT button 266. As shown in FIG. 2, the IN button 264 and the OUT button 266 are located on the stay 212 in this embodiment, but the IN button 264 and the OUT button 266 may be located at other suitable locations such as located at the control console 142 and/or integrated with other control systems for the boat 100. A user presses the OUT button 266 to provide power to the powered actuator 260 such that the powered actuator 260 drives the rod 262 in direction A, and the user presses the IN button 264 to provide power to the powered actuator 260 such that the powered actuator 260 drives the rod 262 in direction B. Any suitable input device may be used including, for example, other types of switches, such as a rocker switch.

As noted above, the claw 241 is pivotably attached to the end of the rod 262. The claw 241 is moveable between an open position and a closed position. As noted above, FIG. 4 shows the claw 241 of the claw mechanism 240 in a closed position. In the closed position, the claw 241 is positioned such that the contact surface 243 of the claw 241 faces the inward direction, which in this embodiment is a direction toward the contact surface 238 of the cross support 236. The claw 241 may include a tip 247, and a line from the pivot axis 245 to the tip 247 defines the angle of the claw 241. Relative to the direction of travel of the rod 262 (directions A and B), the claw 241 is pivoted at an angle a (see FIG. 3) towards the slot 222 in the closed position that is preferably from 30 degrees to 150 degrees, more preferably from 45 degrees to 135 degrees, and even more preferably from 60 degrees to 120 degrees. In the closed position, the claw 241, and more specifically the tip 247 of the claw 241, is rotated to be closer to the slot 222 than it is in the open position.

FIG. 5 shows the claw 241 of the claw mechanism 240 in an open position. In the open position, the claw 241 is positioned in a direction away from the slot 222 such that the board 10 can be inserted into the slot 222. In the open position, the claw 241 is pivoted such that angle a is less than the angles discussed above for the open position. In the open position, the claw 241 may be oriented with angle a preferably being less than 45 degrees and more preferably less than 30 degrees. Negative angles of angle a are also contemplated. In FIG. 5 for example, the claw 241 is oriented in the direction of travel of the rod 262 (directions A and B) such that angle a is zero.

The claw 241 is maintained in the closed position by a biasing member. In this embodiment, the biasing member is a gas spring 250 (pneumatic spring), but other suitable biasing members may be used including, for example, mechanical springs such as compression springs or torsion springs. The gas spring 250 includes a rod 252 that is connected to the claw 241 by a coupling 254. The gas spring 250 is configured to exert a biasing force on the claw 241 to rotate the claw 241 in a closed direction about the pivot axis 245. The gas spring 250 is connected to the claw 241 by a lever 249. In this embodiment, the gas spring 250 is connected to the claw 241 in a counterweight arrangement with the gas spring 250, more specifically, the coupling 254, on an opposite side of the pivot axis 245 from the claw 241. With this arrangement, the gas spring 250 exerts the biasing force in a direction away from the actuator housing 226 to bias the claw 241 towards its closed position. The gas spring 250 exerts the biasing force to rotate the claw 241 about the pivot axis 245 in a direction toward the closed position. The gas spring 250 is also located in the actuator housing 226 next to the powered actuator 260. In this embodiment, the gas spring 250 of the upper rack 220U is positioned above the gas spring 250 of the lower rack 220L and both gas springs 250 are positioned between each of the powered actuators 260.

The claw 241 of the upper rack 220U is shown in its inward-most position in FIG. 2. In this embodiment, in its inward-most position, the claw 241 is positioned outward of the slots 222. To load the board 10 into the upper rack 220U, a user drives the rod 262 of the powered actuator 260 in direction A, such as by pressing the OUT button 266 for the claw 241 of the upper rack 220U. The user drives the rod 262, and thus the claw 241, to its end of travel, which in this embodiment, is an end of linear travel. The rod 252 of the gas spring 250 has a length of travel (end of its travel) that is shorter than the full length of travel of the rod 262 of the powered actuator 260. The rod 252 of the gas spring 250 reaches its full length of travel before the rod 262 of the powered actuator 260 reaches its full length of travel. As the rod 262 of the powered actuator 260 approaches the end of its travel and the rod 252 of the gas spring 250 has reached the end of its travel, the biasing force of the gas spring 250 exerted on the lever 249 is reduced, allowing the end of the lever 249 connected to the coupling 254 to move in direction C in FIG. 4 and causing the claw 241 to pivot about the pivot axis 245 in direction D to an open position as shown in FIG. 5. The location at which the biasing force of the gas spring 250 exerted on the lever 249 is reduced is a position proximate the end of travel for the rod 262 of the powered actuator 260 and the claw 241. In this embodiment, the difference between the length of travel of the rod 252 of the gas spring 250 and the rod 262 of the powered actuator 260, and thus the position proximate the end of travel for the rod 262, is the distance necessary for the portion of the lever 249 connected to the coupling 254 to move in the inward direction (direction C) such that the claw 241 can move to the open position.

The coupling 254 may be slidably coupled to the end of the rod 252 of the gas spring 250 such as by having a socket 256 into which the end of the rod 252 of the gas spring 250 may be inserted. The socket 256 preferably has a geometry that corresponds to the geometry of the rod 252 of the gas spring 250. In this embodiment, the rod 252 of the gas spring 250 is cylindrical and the socket 256 is also cylindrical. The length of the socket 256 is preferably longer than the difference between the full length of travel of the rod 252 of the gas spring 250 and the rod 262 of the powered actuator 260 to prevent the rod 262 of the powered actuator 260 from disengaging from the coupling 254. Other suitable connections may be used between the coupling 254 and the end of the road 252 of the gas spring 250, such as, for example, fasteners or latches. When such connections are used, the rod 252 of the gas spring 250 may exert a force in the direction C to pull the claw 241 in direction E.

Once the claw 241 is in its open position, the board 10 can be slid into the slots 222 of the U-shaped supports 230 without interference of the claw 241. With the board 10 in the slot 222, the user drives the rod 262 of the powered actuator 260 in direction B as shown in FIG. 5, such as by pressing the IN button 264 for the claw 241 of the upper rack 220U. As the rod 262 of the powered actuator 260 travels in direction B, the rod 252 of the gas spring 250 starts exerting the biasing force on the claw 241 to rotate the claw 241 toward the closed position in direction E. More specifically, the rod 252 of the gas spring 250 exerts the biasing force in direction F on the coupling 254 and the lever 249 to pivot the claw 241 about the pivot axis 245.

As the claw 241 is driven inward, the contact surface 243 of the claw 241 contacts the second side edge 14 of the board 10 and pushes the first side edge 12 of the board 10 against the contact surface 238 of the cross support 236, to the extent the first side edge 12 is not already against the contact surface 238 of the cross support 236. The biasing force of the gas spring 250 is set to keep the claw 241 in the closed position as the claw 241 contacts the second side edge 14 of the board 10. When the first side edge 12 of the board 10 contacts the contact surface 238 of the cross support 236, the shape of the contact surface 238 of the cross support 236 and the contact surface 243 of the claw 241 guide the respective first side edge 12 and second side edge 14 of the board 10 to the vertices of the contact surfaces 238, 243, as shown in FIG. 3, for example, securing the board 10 in the upper rack 220U. With the board 10 secured in the upper rack 220U, the user then releases the IN button 264 to stop the inward movement of the rod 262 of the powered actuator 260 and the claw 241.

The biasing force of the gas spring 250 is preferably set to securely hold the board 10 securely in the upper rack 220U and prevent the board 10 from slipping out of the upper rack 220U as the boat 100 is operated. The biasing force of the gas spring 250 should also be low enough that the claw 241 does not damage or crush the board 10. For example, if a user continues to drive the rod 262 of the powered actuator 260, and thus the claw 241, inward after the board 10 is secured in the upper rack 220U, the biasing force of the gas spring 250 is set such that the board 10 pushes the claw 241 towards the open position (direction D), against the biasing force, without causing damage to the board 10. With such a setting, it is also possible to manually open the claw 241 by a user pulling the tip 247 of the claw 241 in direction D to release the board 10 from the upper rack 220U. Depending upon the moment arms of the lever 249 and the claw 241, the biasing force may preferably be set within a desired range, such that the claw 241 preferably exerts a force within a desired range on the board 10 when the board 10 is secured in the upper rack 220U.

As noted above, the rack assembly 200 includes a plurality of racks 220 including the upper rack 220U and the lower rack 220L. Although described as the upper rack 220U and the lower rack 220L with the upper rack 220U being positioned above the lower rack 220L when installed on the boat 100, these racks 220 may have other orientations such that they are next to each other, for example. In these embodiments, the boards 10 are preferably stacked parallel to each other in the racks 220. Preferably, the centerline 224 of the slots 222 of the U-shaped supports 230 of the upper rack 220U (a first rack) are parallel to the centerline 224 of the slots 222 of the U-shaped supports 230 of the lower rack 220L (a second rack).

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A water sports equipment storage rack, comprising:

a seat configured to receive a first portion of a water sport device;

an engagement member that is configured to linearly move in an outward direction away from the seat and in an inward direction toward the seat between an extended position and a retracted position and to rotatably move about a pivot axis between an open position where the engagement member is spaced from a second portion of the water sport device and a closed position where the engagement member abuts the second portion of the water sport device thereby securing the water sport device within the water sports equipment storage rack, wherein the pivot axis is offset from the outward and inward directions; and a drive mechanism configured to linearly move the engagement member in the outward direction during a first portion of the linear movement of the engagement member and configured to rotatably move the engagement member from the closed position to the open position during a second portion of the linear movement of the engagement member.

2. The water sports equipment storage rack of claim 1, wherein the engagement member includes a distal end that is closer to the seat when the engagement member is in the closed position than when the engagement member is in the open position.

3. The water sports equipment storage rack of claim 1, wherein the engagement member includes a recess configured to receive the second portion of the water sport device when the engagement member is in the closed position.

4. A water sports equipment storage rack, comprising:

a seat configured to receive a first portion of a water sport device;

an engagement member that is configured to linearly move in an outward direction away from the seat and in an inward direction toward the seat between an extended position and a retracted position and to rotatably move about a pivot axis between an open position where the engagement member is spaced from a second portion of the water sport device and a closed position where the engagement member abuts the second portion of the water sport device thereby securing the water sport device within the water sports equipment storage rack;

a drive mechanism configured to linearly move the engagement member in the outward direction during a first portion of the linear movement of the engagement member and configured to rotatably move the engagement member from the closed position to the open position during a second portion of the linear movement of the engagement member; and a biasing member configured to bias the engagement member from open position toward the closed position.

5. The water sports equipment storage rack of claim 4, wherein the biasing member includes a gas spring.

6. The water sports equipment storage rack of claim 1, wherein the drive mechanism includes a first rod configured to move the engagement member between the extended and retracted positions.

7. The water sports equipment storage rack of claim 6, wherein the drive mechanism includes a second rod configured to move the engagement member from the closed position to the open position.

8. The water sports equipment storage rack of claim 7, wherein a maximum travel length of the first rod is greater than a maximum travel length of the second rod.

9. The water sports equipment storage rack of claim 1, wherein the seat is position between a pair of space prongs that cooperate with the seat to form a U-shaped receiver configured to receive the water sport device.

10. The water sports equipment storage rack of claim 9, where in the receiver is one of a pair of receivers.

11. The water sports equipment storage rack of claim 1, wherein the engagement member moves along a linear axis as the engagement member moves between the extended and retracted position, and wherein the seat is laterally offset from the linear axis.

12. The water sports equipment storage rack of claim 1, wherein the drive mechanism includes a linear actuator.

13. The water sports equipment storage rack of claim 1, wherein the water sport device includes a wakeboard.

14. A water sports equipment storage rack, comprising:

a support that includes an opening configured to receive a water sport device and a seat opposite the opening and configured to receive a first portion of a water sport device;

an engagement member that is configured to linearly move in an outward direction away from the seat and in an inward direction toward the seat along a linear axis between an extended position and a retracted position and to rotatably move about a pivot axis that is substantial perpendicular to the linear axis between an open position and a closed position where the engagement member abuts a second portion of the water sport device thereby securing the water sport device within the water sports equipment storage rack; and a drive mechanism configured to move the engagement member between the extended and retracted positions;

wherein the engagement member includes a distal end that is closer to the seat when the engagement member is in the closed position than when the engagement member is in the open position.

15. The water sports equipment storage rack of claim 14, wherein the engagement member includes a distal end that is closer to the seat when the engagement member is in the closed position than when the engagement member is in the open position.

16. The water sports equipment storage rack of claim 14, wherein the support includes a pair of space prongs that cooperate with the seat to form a U-shape where the water sport device is received between the prongs.

17. The water sports equipment storage rack of claim 16, wherein the support is one of a pair of supports.

18. The water sports equipment storage rack of claim 14, wherein the engagement member includes a recess configured to receive the second portion of the water sport device when the engagement member is in the closed position.

19. The water sports equipment storage rack of claim 14, further comprising:

a biasing member configured to bias the engagement member from the open position toward the closed position.

20. The water sports equipment storage rack of claim 14, wherein the engagement member moves along a linear axis as the engagement member moves between the extended and retracted position, and wherein the seat is laterally offset from the linear axis.

21. The water sports equipment storage rack of claim 14, wherein the drive mechanism configured to linearly move the engagement member in the outward direction during a first portion of the linear movement of the engagement member and is configured to rotatably move the engagement member from the closed position to the open position during a second portion of the linear movement of the engagement member.

22. The water sports equipment storage rack of claim 21, wherein the drive mechanism includes a first rod configured to move the engagement member between the extended and retracted positions.

23. The water sports equipment storage rack of claim 22, wherein the drive mechanism includes a second rod configured to move the engagement member from the closed position to the open position.

24. The water sports equipment storage rack of claim 23, wherein a maximum travel length of the first rod is greater than a maximum travel length of the second rod.

25. The water sports equipment storage rack of claim 14, wherein the water sport device includes a wakeboard.

26. The water sports equipment storage rack of claim 1, wherein the pivot axis is substantially orthogonal to the outward and inward directions.

* * * * *